US005626076A

United States Patent [19]

Ireton

[11] Patent Number: 5,626,076

[45] Date of Patent: May 6, 1997

[54] PRINTING PLATE MOUNTING SYSTEM, PHYSICAL REGISTER RECORD PLATE AND METHOD EMPLOYING THE SAME

[76] Inventor: Robert E. Ireton, 7865 John Elwood Dr., Centerville, Ohio 45459

[21] Appl. No.: 555,608

[22] Filed: Nov. 9, 1995

[51] Int. Cl.[6] ..... B41C 1/02

[52] U.S. Cl. ..... 101/401.1; 101/481; 101/DIG. 36; 33/614; 33/621

[58] Field of Search ..... 101/485, 486, 101/481, 483, DIG. 36, 401.1, 415.1; 33/614, 620, 621

[56] References Cited

U.S. PATENT DOCUMENTS

| | | | |
|---|---|---|---|
| 4,015,034 | 3/1977 | Smolen | 101/DIG. 36 |
| 4,463,673 | 8/1984 | Moore | 101/DIG. 36 |
| 4,489,652 | 12/1984 | Takeuchi et al. | 101/DIG. 36 |
| 4,611,539 | 9/1986 | Ireton | 101/401.1 |
| 4,679,502 | 7/1987 | Jeschke | 101/415.1 |
| 5,132,911 | 7/1992 | Leader, Jr. et al. | 33/621 |
| 5,133,256 | 7/1992 | Keaton | 101/481 |
| 5,272,980 | 12/1993 | Takeuchi et al. | 101/481 |
| 5,337,668 | 8/1994 | Matsuoka et al. | 101/481 |
| 5,345,868 | 9/1994 | Baker | 101/481 |
| 5,402,726 | 4/1995 | Levien | 101/481 |
| 5,462,836 | 10/1995 | Hornschuh | 101/483 |

OTHER PUBLICATIONS

AV Flexologig B.V. "Mount–O–Matic Table Top" Brochure 1995.

*Primary Examiner*—Eugene H. Eickholt
*Attorney, Agent, or Firm*—R. William Graham

[57] ABSTRACT

A flexible printing plate mounting system, physical register record plate (PRRP) and method employing the same, wherein the system includes a sticky back covered plate cylinder, a plate support surface, arms operably connected to the cylinder for drawing the cylinder toward the support surface in a manner to establish a uniform contact line, the PRRP having a microring formed on a surface thereof and arranged in a fixed position on the support surface such that the microring is in a predetermined position in relation to the contact line, a printing plate having a microdot formed on a surface thereof, wherein the microdot is of a size and configuration to be generally complimentarily received within the microring when positioned thereagainst to place the printing plate in condition for mounting by the plate cylinder.

17 Claims, 6 Drawing Sheets

PRINTING PLATE MOUNTING SYSTEM, PHYSICAL REGISTER RECORD PLATE AND METHOD EMPLOYING THE SAME

BACKGROUND OF THE INVENTION

1. Field of Invention

The present invention relates to a printing plate mounting system and method therefor. More particularly, the invention relates to a flexographic printing plate mounting system, physical register record plate (PRRP) and method employing the mounting system and PRRP.

2. Related Art

Presently, there exists a number of flexographic printing plate mounting systems. Today, such systems typically employ some method of registering the flexographic printing plate onto a plate cylinder by aligning a pair of microdots formed in the printing plate with respect to a central axis of the plate cylinder. The mounting systems which employ the use of microdots operate on the principal of positioning two microdots which are perpendicular to the making direction of the web.

A trend in the industry has been to use a pair of cameras which are ideally in parallel with a shaft of the mounting plate cylinder. Each camera is operatively connected to a split screen monitor to display the position of the microdots. The microdots, and in turn the printing plate, are manually manipulated to bring the microdots into a center screen, thus registering the plate.

A problem which exists with the use of the microdots is that those alignment techniques currently employed today require a relatively high degree of human intervention to make judgments on alignment and positioning. Frequently, this intervention results in error of the registering of plates. Specifically, each plate may vary slightly in registration from another by virtue of the mounter displacing the microdots slight amounts each time a centering of the microdots is accomplished.

One requirement for high multicolor quality printing to be accomplished is that all of the printing surfaces on the respective color printing plates are properly positioned on their respective plate rollers so that when the web being printed upon is fed into contact with printing plates mounted on the successive plate rollers in the press, the several colors will be applied properly to the web in the desired exact position to form the composite images which together reproduce the original photograph being duplicated. This process is also important in some black and white in some applications.

There remains a need in the art to have a mounting device and method employing the same which is less cumbersome, less expensive and reduces the amount of error which is introduced in registering various plates. In essence, there is a need for a simpler system for mounting flexographic printing plates.

SUMMARY OF THE INVENTION

An object of the present invention is to improve printing plate mounting systems.

Another object is to improve the system and method for mounting flexographic printing plates.

Accordingly, the present invention is directed to a system for mounting flexible printing plates, including a sticky back covered plate cylinder, a plate support surface, means operably connected to the cylinder for drawing the cylinder toward the support surface in a manner to establish a uniform contact line, a physical register record plate (PRRP) having a microring formed on a surface thereof, the PRRP being arranged in a fixed position on the support surface such that the microring is in a predetermined position in relation to the contact line, a printing plate having a microdot formed on a surface thereof, wherein the microdot is of a size and configuration to be generally complimentarily received within the microring when positioned thereagainst to place the printing plate in condition for mounting by the plate cylinder. In other words, in a mounting system which utilizes a sticky back plate cylinder, a plate support surface and a flexographic printing plate having a microdot formed on a surface thereof, there is provided a PRRP, which includes a moldable substrate having a microring formed a surface thereof and wherein the microring has a receiving and holding surface generally complimentary to an outer surface of the microdot, and wherein the PRRP is fixably positionable onto the plate support surface such that when the microdot is inserted within the microring, the printing plate is positioned for registration onto the plate cylinder. Additionally, the printing plate may be formed with a pair of microdots and the PRRP may be formed with a complimentary pair of microrings.

In another embodiment, the invention includes a method for preparing flexible printing plates for mounting, comprising the steps of forming a flexible printing plate having a microdot thereon, forming a PRRP having a microring formed thereon, wherein the microring is configured to have a receiving surface generally complimentary to an outer surface of the microdot; orienting the PRRP onto a surface; and interfacing the printing plate with the PRRP such that the microdot is positioned within the microring to ready the printing plate for mounting.

Other objects and advantages will be more apparent from reading the following drawings and description hereto.

DETAILED DESCRIPTION OF THE PREFERRED EMBODIMENTS

Figure 1:
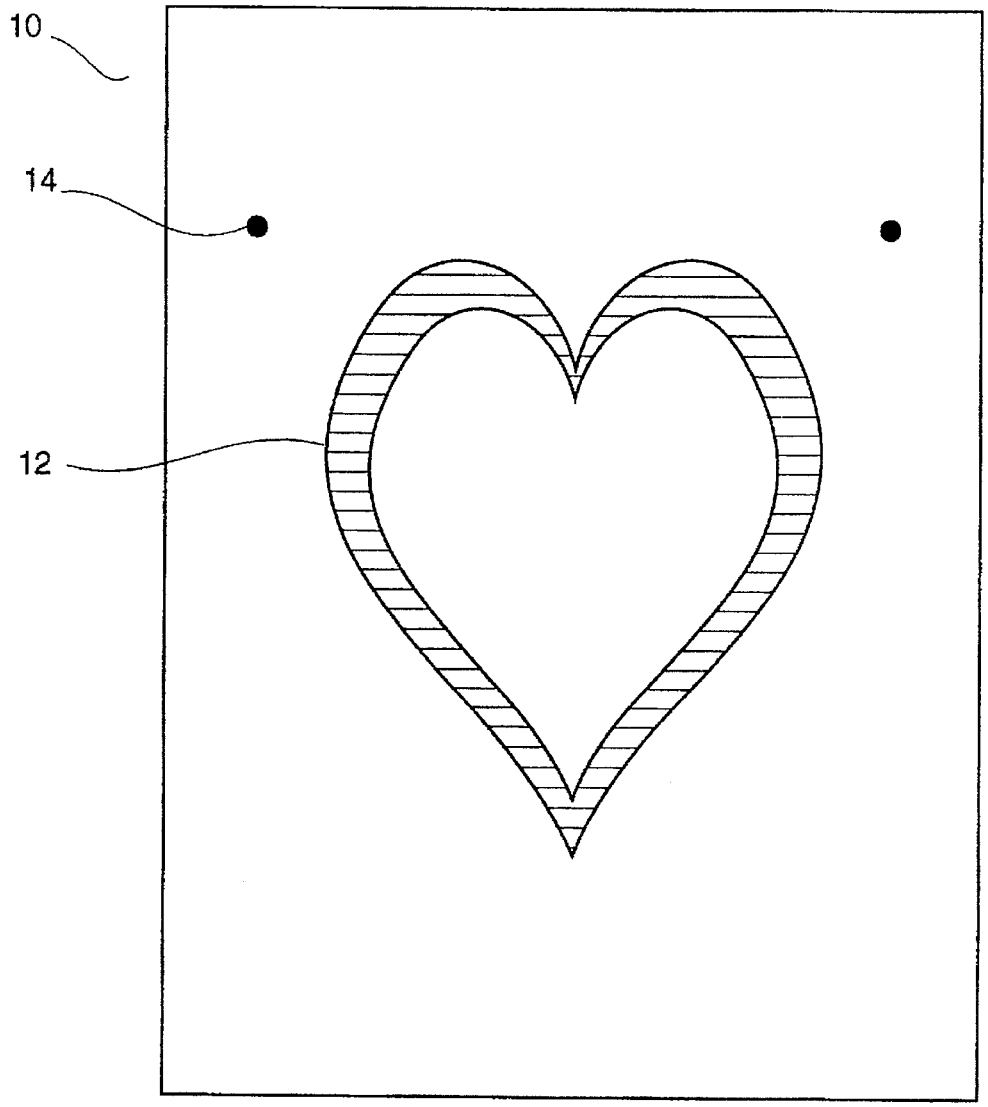
FIG. 1 is a plan view showing a printing plate made in accordance with the present invention having a pair of microdots formed thereon.

Referring now to the drawings, a flexographic printing plate is generally referred to by the numeral 10. The plate 10 may be formed from, for example, a photopolymer of the type from: Dupont Cyrel, B.A.S.F./NAPP Nylo-flex, Hercules pourable polymers, W.R. Grace Flexlite or Supratech Flexceed; or a rubber of the type from: Uniroyal, Good-Year, B.F. Goodrich, Mosstype or Graphic-Arts Rubber. Such materials can typically be obtained in sizes up to 60"×120".

The printing plate 10 is produced in a conventional manner known to the art and as described in Flexography—Principles and Practices—Published by Flexographic Technical Association—Library of Congress Catalog Card No. 80-69506, Chapter VI, Engraving and Printing Pates, pages 149–183, incorporated herein by reference. For the materials listed above, the photopolymer is exposed to an ultraviolet light on one side for a predetermined period to harden and cure the photopolymer to a predetermined depth of a relief to be formed on the other side for the etching process. The other side of the plate is then covered with a photographic negative and exposed to the ultraviolet light to harden the printing surface through to the pre-hardened depth. The photographic negative is removed from the printing plate and the printing plate is washed with a polymer solvent to remove the unhardened material thus providing a printing surface 12. The plate 10 may be more fully hardened if desired.

Figure 2:
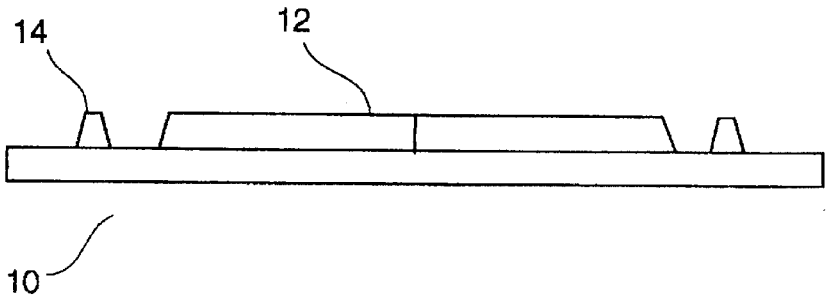
FIG. 2 is an end cross sectional view the printing plate shown in FIG. 1.
Figure 3:
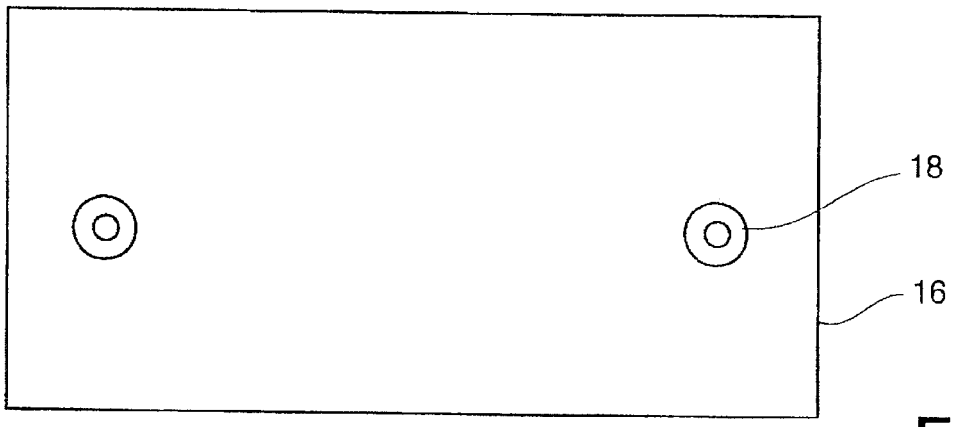
FIG. 3 is a plan view of a physical register record plate (PRRP) made in accordance with the invention having a pair of microrings formed thereon.
Figure 4:
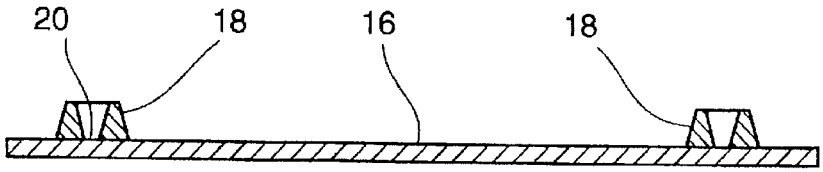
FIG. 4 is an end cross sectional view of the PRRP shown in FIG. 3.

In recent years, the photographic negative has been generated using the aid of a computer. This has enabled the formation highly accurate graphic artwork. Particularly, the artwork can be easily positioned at any desired x and y coordinates. This positioning ability precipitated the invention of the microdots as shown in 14 in FIGS. 1 and 2, a pair of small dots formed in the plate 10, which have been widely used in the industry as a registering aid. The microdots are uniformly formed along an x/y coordinate (via creating a small transparent circle in the photographic negative adjacent the art design) in the plate 10 and have been used principally in the registering process by attempting to align these microdots with a common x/y coordinate of another surface to permit the plate 10 to be mounted in register to a plate cylinder.

In the present invention, a departure from the related art has been made by recognizing that complimentary computer graphic artwork can be created with respect to the microdots. In other words, a photographic negative is formed having a pair of transparent microrings having the same center x, y coordinates as the microdots. The inner diameter of the microring is slightly greater than the diameter defining the transparent circle to account for shouldering effect of the polymer upon hardening.

A physical register record plate (PRRP) 16 is formed in the following manner. The PRRP 16 may be of the type: having a metal backing and a photopolymer of the type described above or B.A.S.F./NAPP Nylo-Print, Toray, Innovative Equip., Innoplate, JET U.S.A., Jet-Plate or Print-Tight; rubber of the type described above; or photo-etched metals such as magnesium, copper or steel. For a purpose of the present invention, a photopolymer type is employed. Similarly, after being prepped, a photographic negative having a pair of transparent rings (centered at positions located identically to the center positions of the transparent circles of the photographic negative for forming the microdots) is placed over the photopolymer and exposed to UV light and subsequently washed for forming the PRRP 16 having the hardened microrings 18 thereon.

Figure 5:
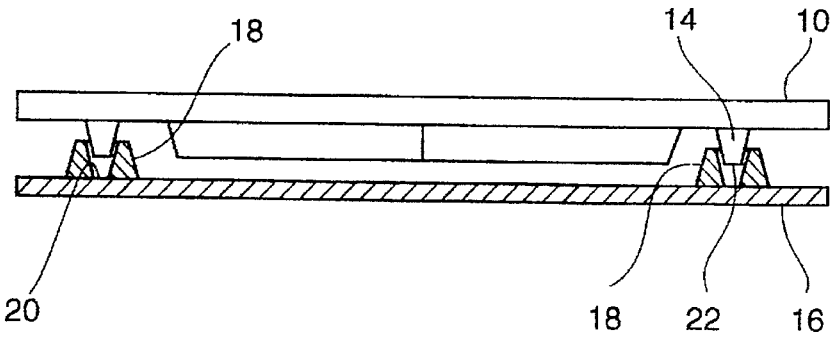
FIG. 5 is an end cross sectional view of the printing plate face to face with the PRRP with the microdots partially disposed into the microrings.
Figure 6:
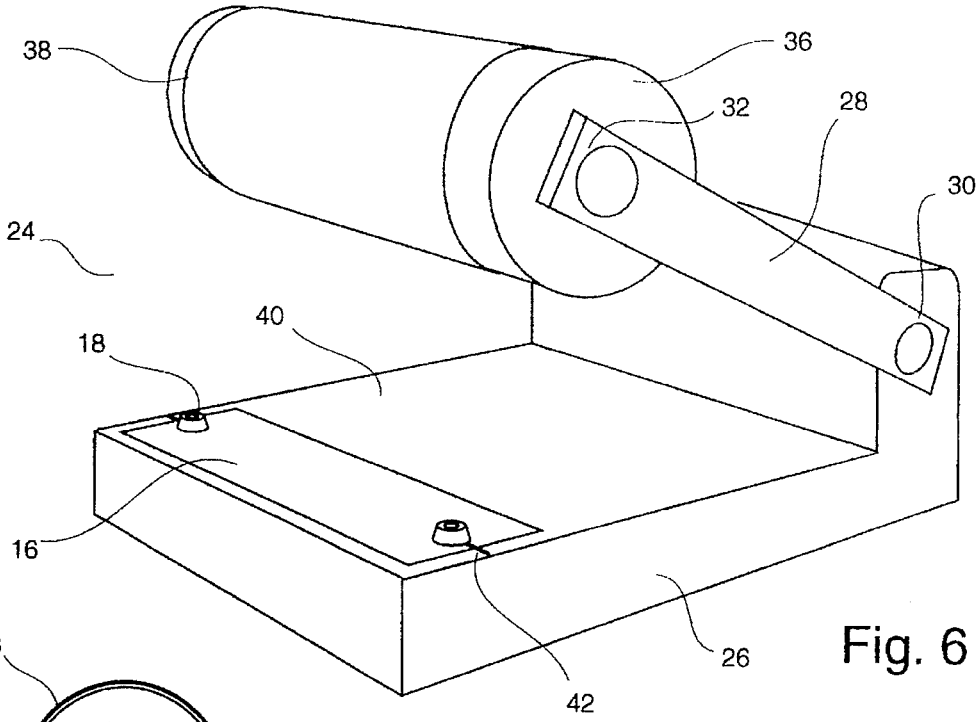
FIG. 6 is a perspective view of a device for completing the mounting of a flexographic printing plate in accordance with the present invention having the PRRP of FIG. 3 disposed thereon.
Figure 7:
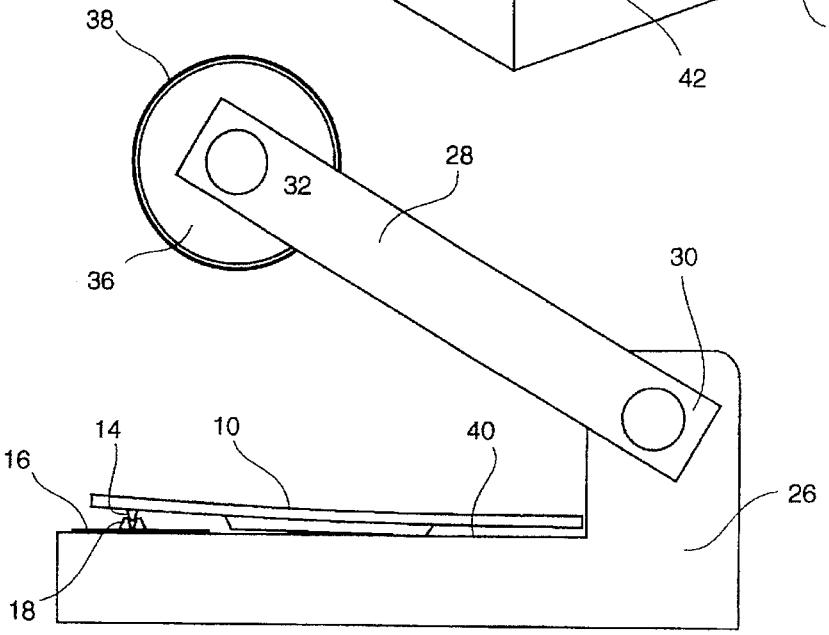
FIG. 7 is a side view of the device and PRRP shown in FIG. 6 having the printing plate of FIG. 1 disposed thereon in a manner depicted in FIG. 5.
Figure 8:
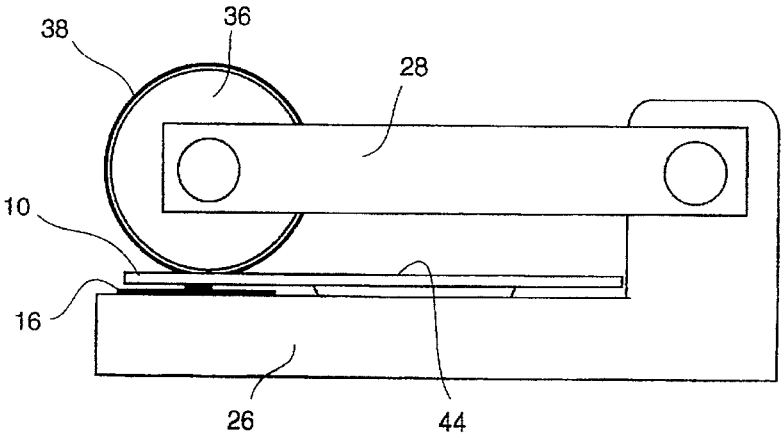
FIG. 8 is another side view of the device and plates shown in FIG. 7.
Figure 9:
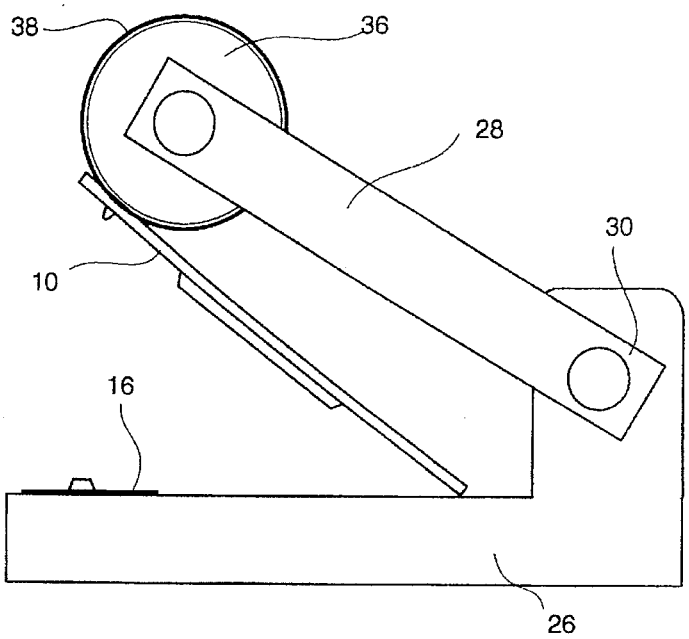
FIG. 9 is another side view of the device and PRRP as shown in FIG. 6 having the printing plate attached to a plate cylinder of the device.
Figure 10:
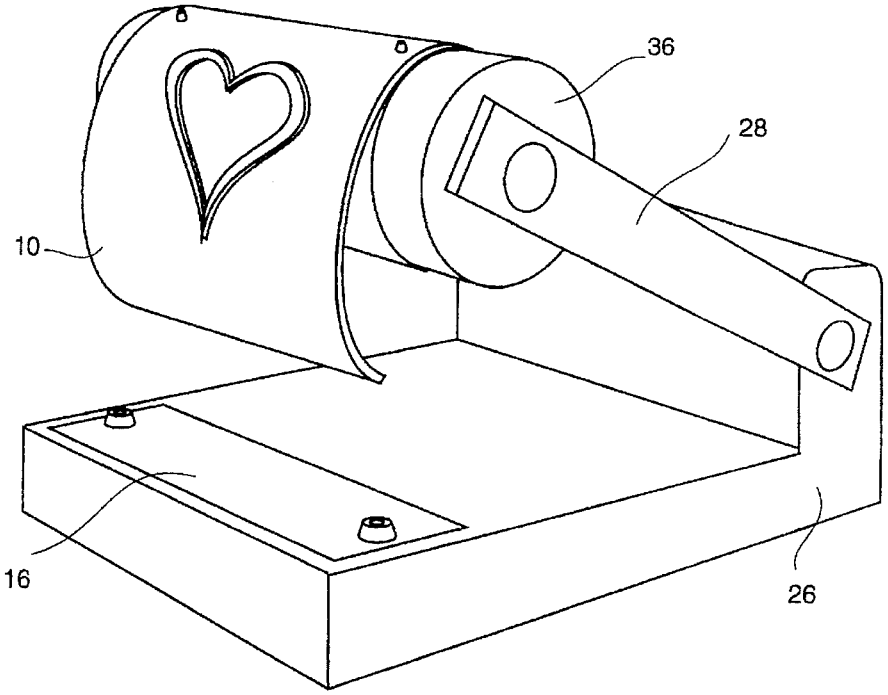
FIG. 10 is perspective view of the device and PRRP as shown in FIG. 6 having the printing plate attached to a plate cylinder of the device.

Ideally, the bottom surface 20 formed within the microrings 18 will be slightly less than the size of the microdots 14 such that the terminal end 22 of the microdots 20 do not touch the bottom surface 20 of the microrings 18. As seen in FIG. 5, the microdots 14 partially seat within the microrings 18, which permits easier separation of the plate 10 from the PRRP 16.

The mounting device 24 depicted in FIGS. 6–10 and 13, includes a support base 26, a pair of arms 28 removably hingedly connected at one end 30 to the support base 26. Rotatably removably connected at the other end 32 of the arms 28 is a plate cylinder 36 onto which the printing plate 10 is to be mounted. Commonly, the plate cylinder 36 will include a sticky back 38 for affixing the printing plate 10.

In operation, the PRRP 16 is fixedly disposed onto a surface 40 of the base 26 in a manner to place the microrings 18 in register or alignment with the plate cylinder 36, typically a central axis of the plate cylinder 36. This can be done by providing markings 42 on the surface 40 and aligning the microrings 18 with the markings and then fixing the PRRP 16 to the surface 40. While the PRRP 18 may be skewed, but this will not matter as all of the printing plates 10 will be mounted off the same PRRP 16 for any one particular printed design and, thus, while slightly skewed with the plate cylinder 36, all plates 10 are in register with one another and a multicolor print, for example, are produced in substantially perfect register.

Each time a plate 10 is to be placed down on the surface 40 for mounting, the microdots 14 are first positioned within the microrings 18. Then, the arms 28 are actuated to a point wherein the sticky back 38 of the plate cylinder 36 is brought into contact with the back surface 44 of the plate 10. The arms 28 are then actuated in opposite direction such that the plate cylinder 36 is disposed away from the surface 40 having the printing plate 10 adhered thereto and to permit the plate 10 to be rolled into position on the plate cylinder 36. The plate cylinder 36 can then be removed from the arms 28 for use in a desired application.

Figure 14:
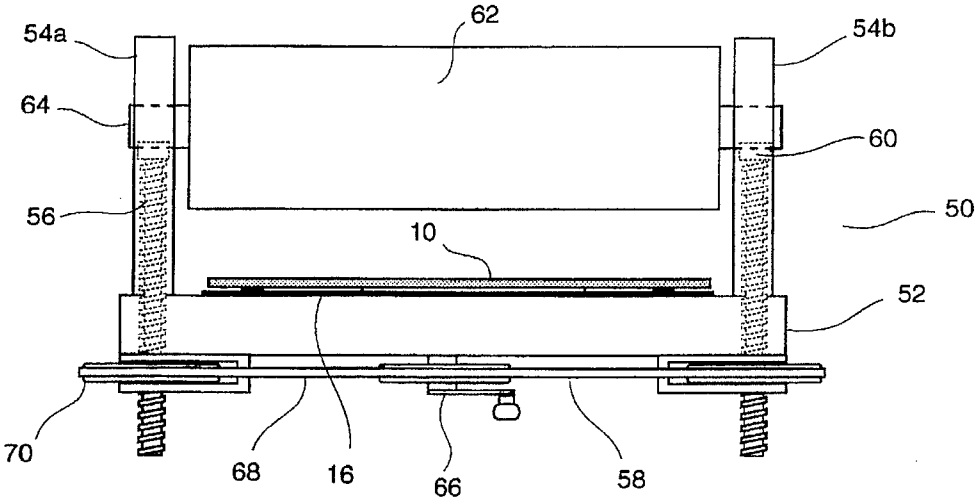
FIG. 14 is an end view of another embodiment of a mounting device for use in the present invention.
Figure 16:
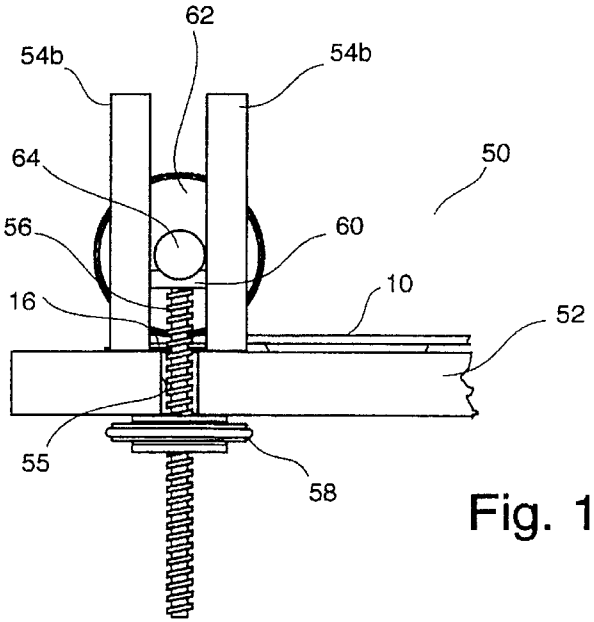
FIG. 16 is another end view of the device in FIG. 14 in another operational position.
Figure 15:
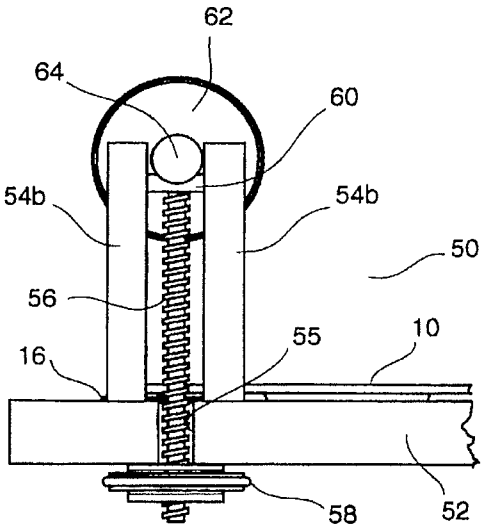
FIG. 15 is an end view of the device in FIG. 14.

Alternatively, as seen in FIGS. 14–16, the mounting device 50 is employable for use in mounting varying size plate cylinders. The mounting device 50 includes a support base 52, support members 54 fixedly connected to the base 52 in a predetermined alignment relationship to the base 52, bored surfaces 55, threaded shafts 56 and means 58 for reciprocating the threaded shafts 56. One of the shafts 56 extends through one of the bore surfaces 55 and has fixed to one end a bearing member 60 connected thereto which slidably fits between the support members 54. A plate cylinder 62 having a shaft 64 is disposed between the support members 54*a* and 54*b* such that the shaft 64 bears upon the bearing member 60. The shaft 64 is preferably of a diameter slightly less than the distance between support members 54*b* (wherein the distance between support members 54*a* and support member 54*b* are the same) to keep the plate cylinder 62 in a predetermined alignment with respect to the PRRP 16.

The reciprocating means 58 includes a crank 66 and operably connected arms 68 and threaded wheels 70. The wheels 70 are operably connected to the threaded shafts 56 such that when the crank 66 is turned, the wheels 70 rotate to cause the shafts 60 to uniformly move between the support members 54*b* (likewise between 54*a*) thus moving the plate cylinder 62 toward or away from the support base 52 depending upon the direction the crank 66 is turned. It is recognized that other mechanisms may be employed to accomplish this result, such as a hydraulic mechanism.

The mounting process of the plate 10 is essentially the same for the device 50 as that described for the device 24, wherein a difference exists in how the plate cylinders 38 and 62 are brought into contact with the plate 10. It is believed that the device 50 provides an additional feature of being able to easily mount in register plates of varying sizes onto complimentary sized plate cylinders by virtue the shaft 62 remaining uniformly positioned and centered over the microrings 18 regardless of the plate cylinder size.

While the present invention has discussed the use of microdots and microrings in conjunction with the mounting system, there is a myriad of other male female configurations which may be employed to accomplish the same result and accordingly are equivalents in function to the present invention. For example, a register mark is typically formed on every color plate. A complimentary female register mark may be formed on the PRRP for use in mounting. Also, it may be that the print surface design is symmetrical about a center point and a single microdot or a central feature of the print surface may be used in conjunction with a single microring or complimentary feature in which to register the printing plate.

Figure 11:
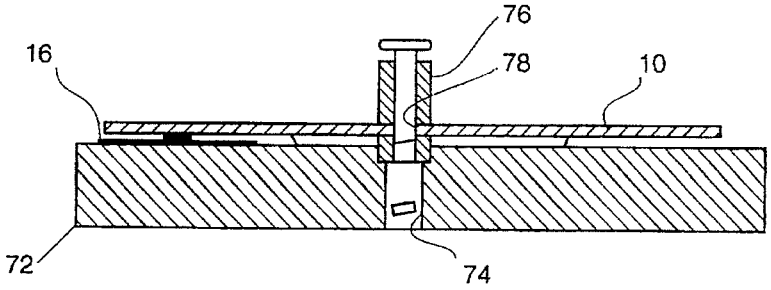
FIG. 11 is another embodiment of the present invention with the PRRP and printing plate disposed in a manner depicted in FIG. 5 and having a plate boring apparatus in connection therewith.

As shown in FIG. 11, there is provided an additional embodiment. Here a support base 72 includes a bored surface 74 and an operably associated plate boring apparatus 76 is used to bore a hole in the plate 10 once positioned onto the PRRP 16. In this regard, the surface 78 defining the hole can be used in conjunction with certain mounting devices which mount plates by registering about a bored surface.

Figure 12:
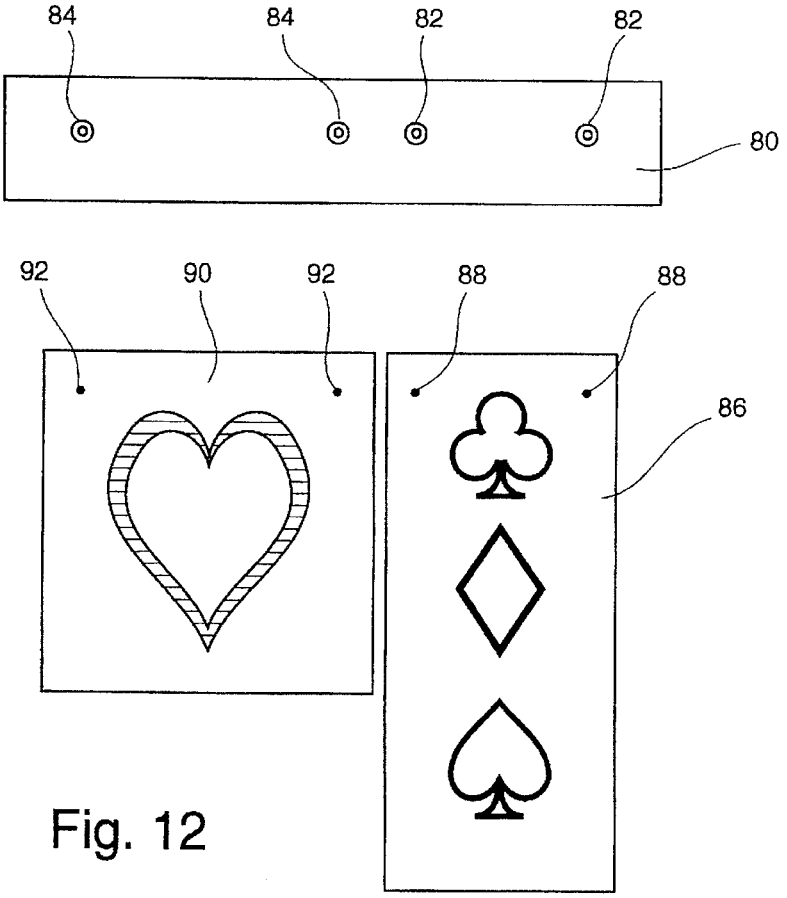
FIG. 12 is a plan view of a PRRP having pairs of microrings formed thereon in relation to a pair of printing plates each having a pair of microdots which correspond to one of the pair of microrings.
Figure 13:
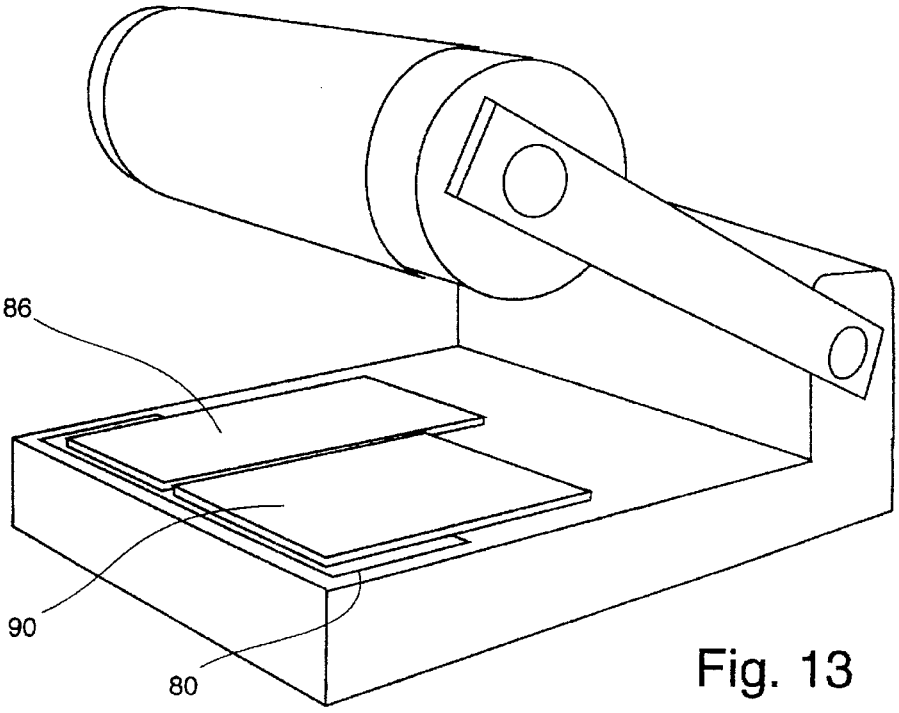
FIG. 13 is a perspective view of the device with the printing plates of FIG. 12 face to face with the PRRP of FIG. 12 with the microdots partially disposed into the microrings.

As previously discussed, some of the plate materials described above are limited in their size in which they can be formed. In other cases, it is desirous to prepare different strips of printed art work which can be ganged together for a run. FIG. 12 shows a PRRP 80 having microrings 82 and 84 and printing plates 86 with microdots 88 and printing plate 90 with microdots 92. Here, the microdots 88 and 92 are seated into microrings 82 and 84, respectively. Thus, the plates 86 and 90 can be ganged together for mounting as shown in FIG. 13. The PRRP 80 notably is also capable of registering and mounting each plate individually.

By so providing the present invention, there has been created a novel and improved printing plate mounting system which substantially eliminates human error in aligning and registering the flexographic printing plates onto a plate cylinder. The preset invention has also substantially reduced the cost and ease in which the flexographic printing plate mounting process is accomplished.

There will be many modifications and variations to the present invention which will be readily apparent to those skilled in the art and the embodiment set forth above is put forth by way of example for flexible printing plate mounting system but will have application to other techniques such as letter press, for example. Additionally, it is contemplated that the PRRP may be placed on any fixed plate support or slidably movable fixable plate support which is movable along the contact line described above. Accordingly, such modifications and variations should be within the scope of the claims appended hereto.

What is claimed is:

1. A system for mounting flexible printing plates, comprising:

a sticky back covered plate cylinder;

a plate support surface;

means operably connected to said plate cylinder for drawing said plate cylinder toward said plate support surface in a manner to establish a uniform contact line;

a physical register record plate (PRRP) having a microring formed on a surface thereof, said PRRP being arranged in a fixed position on said plate support surface such that said microring is in a predetermined position in relation to said contact line;

a printing plate having a print surface and a microdot formed on a surface thereof, wherein said microdot is of a size and orientation on said printing plate with respect to said print surface to be generally complimentarily received within said microring when positioned thereagainst thus placing said printing plate in condition for mounting by said plate cylinder.

2. The mounting system of claim 1, wherein said microring is arranged such that a center point thereof is substantially along said contact line.

3. The mounting system of claim 1, wherein said microring has a receiving and holding surface configured similarly to an outer surface of said complimentary microdot and further characterized to have a bottom surface of a size slightly smaller than a size of said microdot so that said microdot only partially seats into said microring to permit easier separation of said printing plate from said PRRP.

4. The mounting system of claim 1, which is further characterized to include a pair of microdots formed on said printing plate and a pair of microrings formed on said PRRP, wherein said microrings are arranged such that a center point of each said microrings is substantially along said contact line.

5. The mounting system of claim 4, wherein each said microring has a receiving and holding surface configured similarly to an outer surface of each said complimentary microdot and further characterized to have a bottom surface of a size slightly smaller than a size of said microdot so that said microdots only partially seat into said microrings to permit easier separation of said printing plate from said PRRP.

6. The mounting system of claim 1, which further includes a plate boring apparatus operably associated with said plate support surface for boring a hole into said printing plate.

7. The mounting system of claim 1, wherein said plate support surface is part of a support base and said drawing means includes an arm pivotally connected at one end to an end of said plate base and removably rotatably connected at another end to said plate cylinder.

8. The mounting system of claim 1, wherein said drawing means includes a member removably rotatably supportively associated at one end with said plate cylinder and which is reciprocatable with respect to said plate support surface.

9. A method for preparing flexible printing plates for mounting, comprising the steps of:

(a) forming a flexible printing plate having a print surface and microdot thereon;

(b) forming a flexible physical register record plate (PRRP) having a microring formed thereon, wherein said microring is of an orientation on said PRRP and is configured to have a receiving surface generally complimentary to an outer surface of said microdot;

(c) orienting said PRRP onto a plate support surface; and (d) interfacing said printing plate with said PRRP such that said microdot is positioned within said microring to ready said printing plate for mounting.

10. The method of claim 9, wherein the step d is further characterized to be fixedly orienting said PRRP onto said plate support surface.

11. The method of claim 9, wherein the step a is further characterized to be forming a pair of microdots, the step b is further characterized to be forming a pair of microrings having a spacing with respect to one another which substantially equals to the spaced relation between said microdots.

12. A method for mounting flexible printing plates, comprising the steps of:

(a) forming a flexible printing plate having a microdot thereon;

(b) forming a flexible physical register record plate (PRRP) having a microring formed thereon, wherein said microring is configured to have a receiving surface generally complimentary to an outer surface of said microdot;

(c) orienting said PRRP onto a surface;

(d) interfacing said printing plate with said PRRP such that said microdots are positioned within said microring to ready said printing plate for mounting; and (e) drawing into contact with said printing plate a print cylinder in a manner wherein said printing plate adheres to said cylinder upon contact and separates from said PRRP resulting in said printing plate being registered.

13. The method of claim 12, which further includes the steps of:

(f) forming another flexible printing plate having a microdot thereon;

(g) interfacing said another printing plate with said PRRP such that said microdot of said another printing plate is positioned within said microring to ready said another printing plate for mounting; and (h) drawing into contact with said another printing plate another print cylinder in a manner wherein said another printing plate is adhering to said another cylinder upon contact and separated from said PRRP resulting in said another plate being registered onto said another cylinder in such a manner that said printing plate and said another printing plate is substantially in register with one another.

14. The method of claim 12, wherein the step a is further characterized to be forming a pair of microdots, the step b is further characterized to be forming a pair of microrings having a spacing with respect to one another which substantially equals to the spaced relation between said microdots.

15. The method of claim 14, which further includes the steps of:

(f) forming another flexible printing plate having a pair of microdots thereon;

(g) interfacing said another printing plate with said PRRP such that said microdots of said another printing plate is positioned within said microrings to ready said another printing plate for mounting; and (h) drawing into contact with said another printing plate another print cylinder in a manner wherein said another printing plate is adhering to said another cylinder upon contact and separated from said PRRP resulting in said another plate being registered onto said another cylinder in such a manner that said printing plate and said another printing plate is substantially in register with one another.

16. In a mounting system which utilizes a sticky back plate cylinder, a plate support surface and a flexible printing plate having a microdot formed on a surface thereof, a physical register record plate (PRRP), which includes a moldable substrate having a microring formed on a surface thereof and wherein said microring has a receiving and holding surface generally complementary to an outer surface of the microdot, and wherein said PRRP is fixably positionable onto the plate support surface such that when the microdot is inserted within said microring, the printing plate is positioned for registration onto the plate cylinder.

17. In the mounting system recited in claim 16 wherein the printing plate is further characterized to include a pair of microdots, the PRRP is further characterized to include a pair of complimentary microrings wherein each said microring has a receiving and holding surface configured similarly to an outer surface of each said complimentary microdot and further characterized to have a bottom surface of a size slightly smaller than a size of each said microdot so that said microdots only partially seat into said microrings to permit easier separation of the printing plate from said PRRP.

* * * * *